US008702419B2

(12) United States Patent
Simpson

(10) Patent No.: US 8,702,419 B2
(45) Date of Patent: Apr. 22, 2014

(54) AUTOMATED CANDLE BLOWER

(76) Inventor: Rickey Simpson, San Antonio, TX (US)

( * ) Notice: Subject to any disclaimer, the term of this patent is extended or adjusted under 35 U.S.C. 154(b) by 381 days.

(21) Appl. No.: 13/080,476

(22) Filed: Apr. 5, 2011

(65) Prior Publication Data

US 2011/0244406 A1 Oct. 6, 2011

Related U.S. Application Data

(60) Provisional application No. 61/341,818, filed on Apr. 5, 2010.

(51) Int. Cl.
*F23Q 25/00* (2006.01)

(52) U.S. Cl.
CPC ..... *F23Q 25/00* (2013.01)
USPC ..... 431/145; 431/6; 431/300; 431/311; 431/312; 431/313; 431/314

(58) Field of Classification Search
CPC ..... F23Q 25/00
USPC ..... 431/6, 300, 311, 312, 313, 314, 145
See application file for complete search history.

(56) References Cited

U.S. PATENT DOCUMENTS

| | | | | |
|---|---|---|---|---|
| 3,150,831 | A * | 9/1964 | Bosak | 239/211 |
| 3,717,936 | A * | 2/1973 | Tolmie et al. | 34/99 |
| 6,780,007 | B1 * | 8/2004 | Coffin, Sr. | 431/297 |
| 7,132,084 | B1 | 11/2006 | Roumpos | |
| 7,226,284 | B2 * | 6/2007 | Avelar | 431/33 |
| 7,607,916 | B2 * | 10/2009 | Almodovar | 431/320 |
| 2007/0031769 | A1 | 2/2007 | Burton et al. | |
| 2007/0072140 | A1 | 3/2007 | Almodovar | |
| 2007/0273326 | A1 * | 11/2007 | Krieger et al. | 320/110 |
| 2008/0076082 | A1 * | 3/2008 | Wolfson | 431/145 |
| 2009/0200393 | A1 | 8/2009 | Avelar | |
| 2011/0229833 | A1 * | 9/2011 | Valentine | 431/6 |

FOREIGN PATENT DOCUMENTS

| | | |
|---|---|---|
| WO | WO87/03070 | 5/1987 |
| WO | WO2008/143806 | 11/2008 |

* cited by examiner

*Primary Examiner* — Kenneth Rinehart
*Assistant Examiner* — Gajanan M Prabhu
(74) *Attorney, Agent, or Firm* — Scherrer Patent & Trademark Law, P.C.; Stephen T. Scherrer

(57) ABSTRACT

An automatic candle blower having a main housing with a base and a back member. The back member has a plurality of vent holes therethrough, each of the vent holes providing an air flow path from the interior of the main housing. A candle support surface is formed adjacent to the back member to support a candle. A blower is positioned to direct air to the vent holes. An air channel is formed within the main housing between the blower and the vent holes. An alternative embodiment of the invention further includes a control circuit, which has a processor, a timer, and a processor-readable medium, is electrically connected to the blower. A user input device is electrically connected to the control circuit.

20 Claims, 6 Drawing Sheets

AUTOMATED CANDLE BLOWER

CROSS REFERENCE TO RELATED APPLICATIONS

This application claims the benefit of U.S. provisional application Ser. No. 61/341,818, filed Apr. 5, 2010, which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to a candle blower. More specifically, the present invention is an automated candle blower programmable to direct a flow of air to the general position of a flame on a burning candle.

2. Description of the Related Art

According to one government study, in 2006, an estimated 23,600 fires in residences were caused by candles, resulting in 1525 civilian injuries, 165 deaths, and $390 million in property damage. Unattended burning candles caused a large portion of these fires.

Numerous attempts have been made to address the problem of unattended, burning candles and the dangers they present. For example, U.S. Pat. No. 7,226,284 (issued on Jun. 5, 2007) describes a controller electrically connected to a fan that, when actuated, forces air into a transparent cover. A series of openings are formed in the candle support. The invention of the '284 patent operates by continually providing air into the cover through the openings for so long as candle burning is desired. To extinguish the candle, air flow is stopped—that is, the fan is deactivated.

U.S. Published Application 2008/0076082 (published Mar. 27, 2008) also incorporates a fan orientated to create a horizontal air stream toward a flaming wick of a candle. The invention also incorporates a countdown timer. The invention may be remotely actuated with a transmitter.

U.S. Published Application 2007/0072140 (published Mar. 29, 2007) describes a system that includes a base with an extinguishing fluid situated within the base. Movement of a solenoid arm causes actuation of a spray nozzle to direct fluid, such as air, to the top of the candle through channels formed in a shell in which the candle is placed. The solenoid is actuated after a predetermined elapsed time, when a specific temperature is reached, or if a tilt sensor is triggered.

U.S. Pat. No. 7,132,084 (issued Nov. 7, 2006) discloses a candle warmer having a base and a fan orientated to direct air flow close to a candle resting on the base. This invention is not intended to control the flame of the candle, but rather to disperse the smell from the scented wax.

BRIEF SUMMARY OF THE INVENTION

The present invention is an automatic candle blower having a main housing with a base and a back member. The back member has a plurality of vent holes therethrough, each of the vent holes providing an air flow path from an interior space of the back member. A candle support surface is formed adjacent to the back member to support a candle. A blower is positioned to direct air to the vent holes. An air channel is formed within the main housing between the blower and the vent holes.

An alternative embodiment of the invention further includes a control circuit, which has a processor, a timer, and a processor-readable medium, that is electrically connected to the blower. A user input device and display are electrically connected to the control circuit.

DETAILED DESCRIPTION OF THE INVENTION

While the terms "upper," "lower," "front," "rear," and similar terms are used throughout this document, it should be understood that such are simply terms of convenience only to aid in description of the invention.

Figure 1:
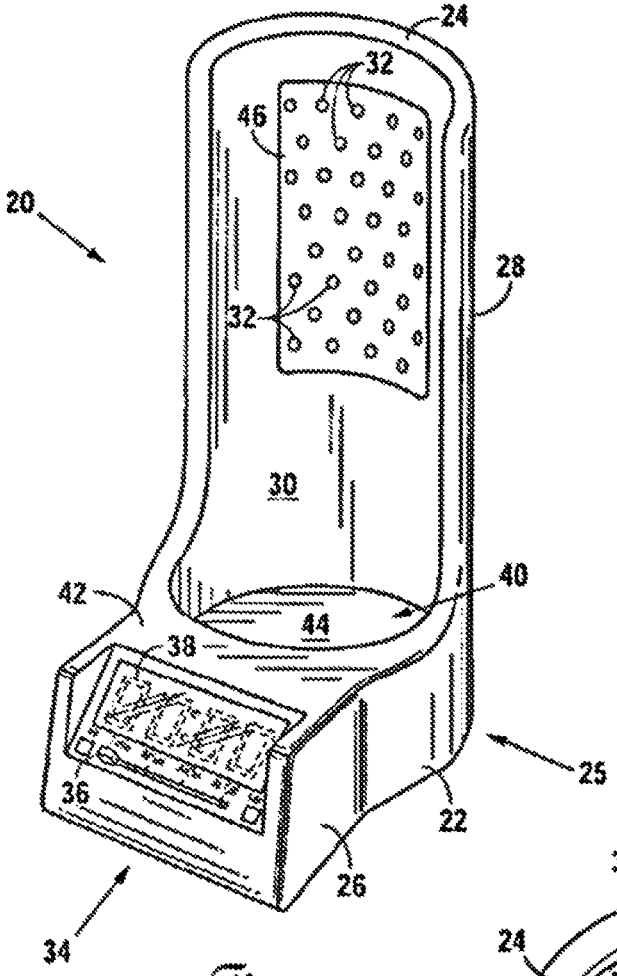
FIG. 1 is an isometric view of a preferred embodiment of the invention.
Figure 2:
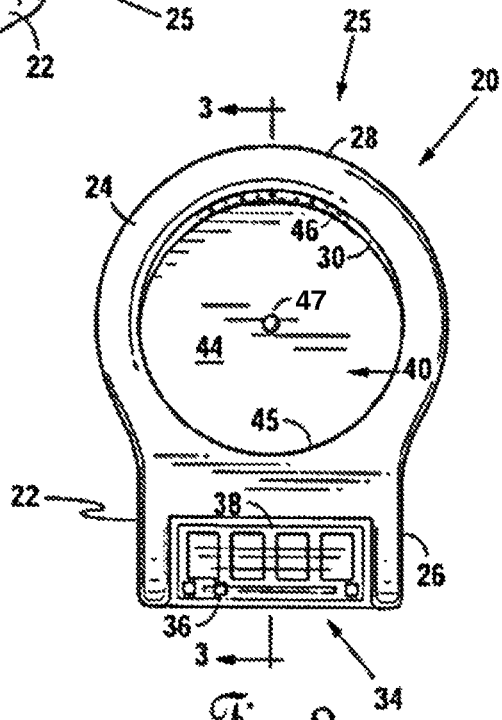
FIG. 2 is a top elevation of the embodiment shown in FIG. 1.

FIGS. 1-2 show the preferred embodiment 20 of the invention, which comprises a generally L-shaped main housing 22 that has a base 26 with a rear end 25 that is generally circular in shape and a front end 34. A back member 24 extends upward from the rear end 25 of the base 26. The back member 24 and base 26 each enclose a first and second interior space, respectively.

The back member 24 has a back wall 28 and a front wall 30, and is curved to partially encircle a space above the base 26 to be occupied by a candle during use. A plurality of vent holes 32 through the front wall 30 of the back member 24 provide air paths from an interior space within the back member 24. In this embodiment, the vent holes 32 are formed in a vent plate 46 that forms a portion of the front wall 30. However, it is also anticipated that the vent holes 32 could be formed through the front wall 30 without the use of a vent plate 46.

A circular depression 40 is formed in the base 26 of the main housing 22. The depression 40 is bordered in the rear by the front wall 30 of the back member 24 and bordered in the front by a vertical shoulder 45 (see FIG. 2). The bottom of the depression 40 is a horizontal, circular candle support surface 44. The candle support surface 44 is adjacent to the front wall 30 of the back member 24 at the rear and adjacent to the vertical shoulder 45 at the front. A spiked member 47 (FIG. 3) extends upward from the candle support surface 44.

A user input device 36 and a display 38 are positioned proximal to the front end 34. The user input device 36 is adapted to accept user input for a time at when the user desires to extinguish a candle resting on the embodiment. The display 38 may be an LCD, LED, or other suitable type sufficient to provide information to the user necessary for operation of the embodiment, such as the current time, the programmed time for actuation of the air flow, time remaining until actuation, status and error codes, and the like.

Figure 3:
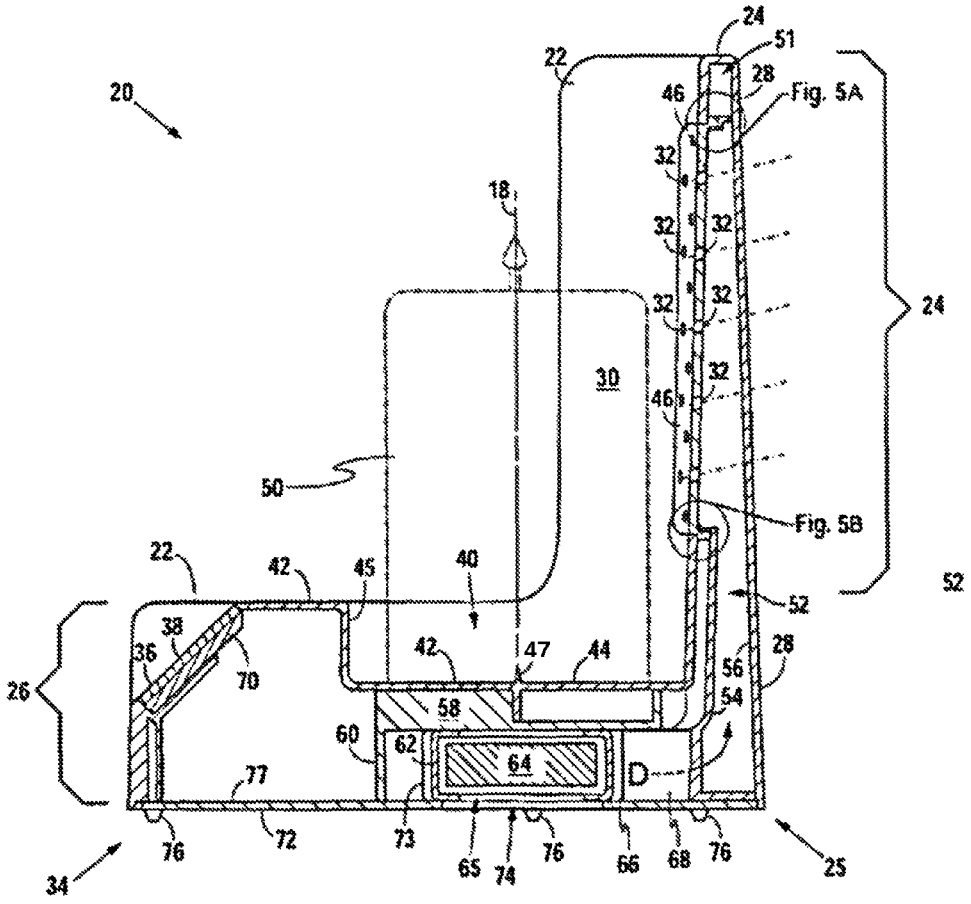
FIG. 3 is a side sectional elevation though section line 3-3 of FIG. 2.

FIG. 3 is a side elevation of the preferred embodiment through section line 3-3 of FIG. 2. A candle 50 rests on the support surface 44 and is at least partially held in place with the spiked member 47. The back member 24 of the main housing 22 extends at least substantially perpendicular to the candle support surface 44, although the back wall 28 and front wall 30 can be at a slight angle from vertical such that the back member 24 angles away from the candle support surface 44. The back member 24 encloses a first interior space 51 formed between the back and front walls 28, 30.

A vent plate 46 is positioned in an opening in the front wall 30. Vent holes 32 formed through the vent plate 46 are generally angled downwardly and generally directed radially inward toward a vertical axis 18 intersecting the center of the support surface 44. In the preferred embodiment, the vent holes 32 are angled downwardly at fifteen degrees from horizontal. The curvature of the vent plate 46 corresponds to the curvature of the front wall 30.

A channeling member 54 having an interior surface 59 is positioned within the first interior space 51 and forms an air channel 52 between the vent holes 32 and the base 26. The air channel 52 is also partially defined by the interior surface 56 of the back wall 28.

Figure 4:
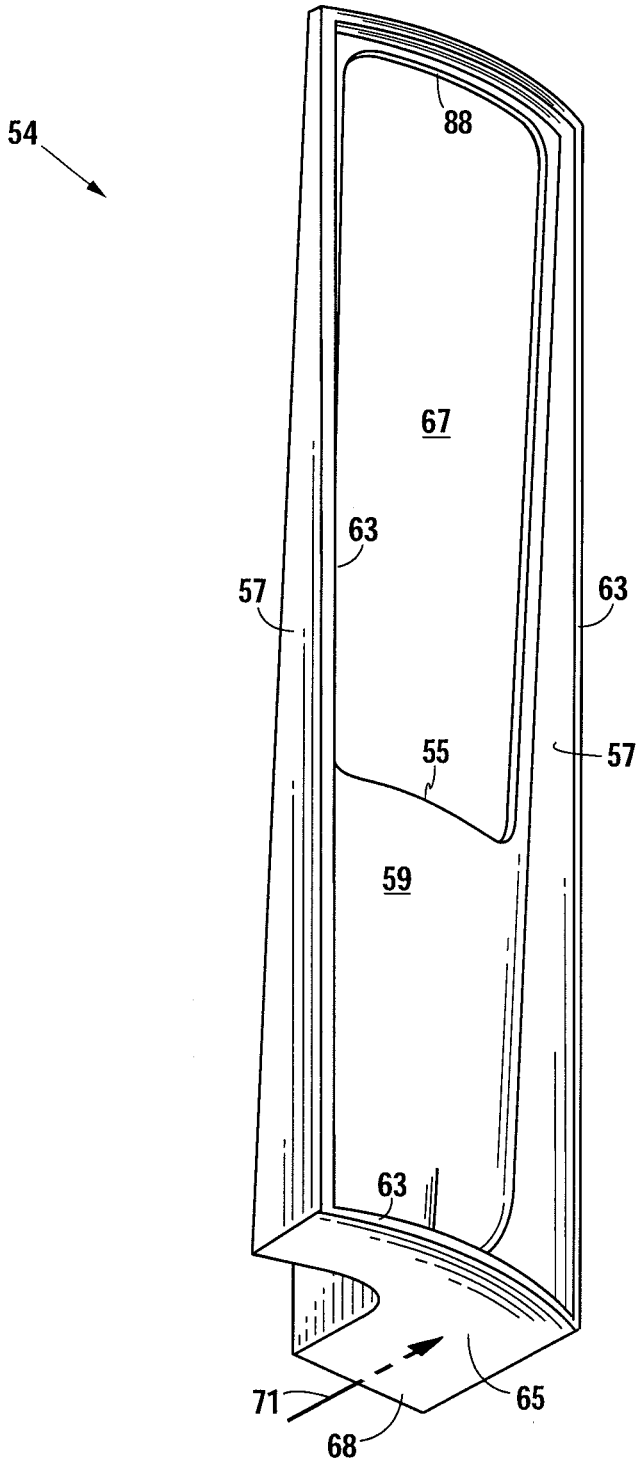
FIG. 4 is a rear isometric view of the channeling member of the preferred embodiment.

FIG. 4 shows the channeling member 54 of FIG. 3 in more detail. The channeling member 54 includes two vertical sidewalls 57 connected to a front wall 55, a bottom wall 61, and the interior surface 59. The channeling member 54 is open to the rear. The channeling member 54 further comprises a front inlet 68 to receive air flow 71. The rear surfaces 63 of the sidewalls 57 and bottom wall 65 correspond to the curvature of the rear wall of the back member (not shown). An opening 67 is formed through the front wall 55 to receive the vent plate (not shown). A flanged shoulder 88 defines the top end of the opening 67.

Figure 5A:
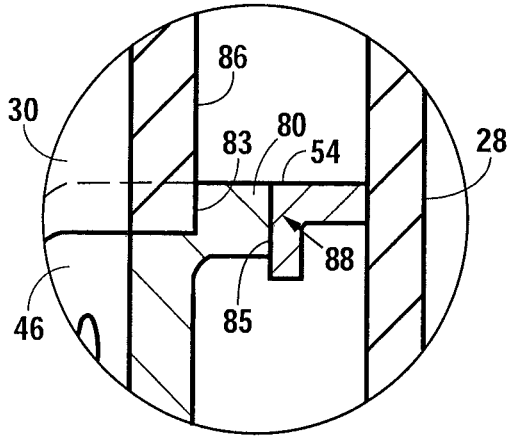
FIGS. 5A and 5B are enlarged views of window 5A and 5B, respectively, of FIG. 3.
Figure 5B:
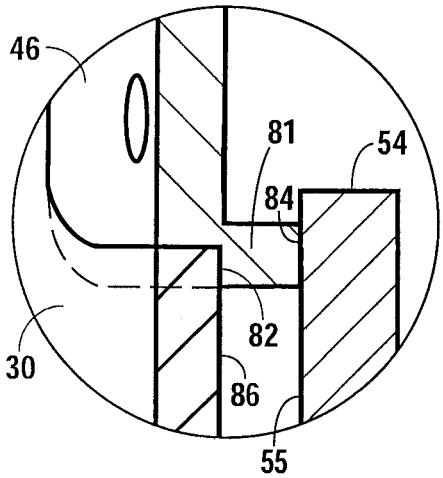

FIGS. 3 and 5A-5B show the association between the vent plate 46, the front wall 30 of the back member 28, and the channeling member 54 at the top and bottom ends of the vent plate 46, respectively. As shown in FIG. 5A, a front surface 83 and a rear surface 85 of an upper lip 80 formed at the top of the vent plate 46 is positioned between an upper flanged shoulder 88 of the channeling member 54 and the interior surface 86 of the front wall 30. As shown in FIG. 5B, a lower lip 81 formed at the bottom of the vent plate 46 has a front surface 82 and a rear surface 84 positioned between the interior surface 86 of the front wall 30 and the front wall 55 of the channeling member 54. Preferably, the upper and lower lips 80, 81 are positioned between the interior surface 86 of the front wall 30 and the channeling member 54 with an interference fit. Additionally, the vent plate 46 may be secured in place with an adhesive or bonding agent applied between the various components or may be integrally formed with the channeling member 54.

Referring back to FIG. 3, a generally-cylindrical blower mount 58 is fixed to the main housing 22 within the rear end 25 of the base 26. The blower mount 58 includes a semicircular shoulder 60 that extends to downward to the bottom of the main housing 22. A generally-cylindrical blower housing 62 is fixed to the blower mount 58, and houses a blower 64 (i.e., a centrifugal fan). The blower housing 62 has an inlet 65, and an outlet 66 orientated to direct air to the air channel 52. An air channel inlet 68 is positioned adjacent to the outlet 66 of the blower housing 62 to receive air flow therefrom and direct the air flow in direction D into the air channel 52.

Figure 6:
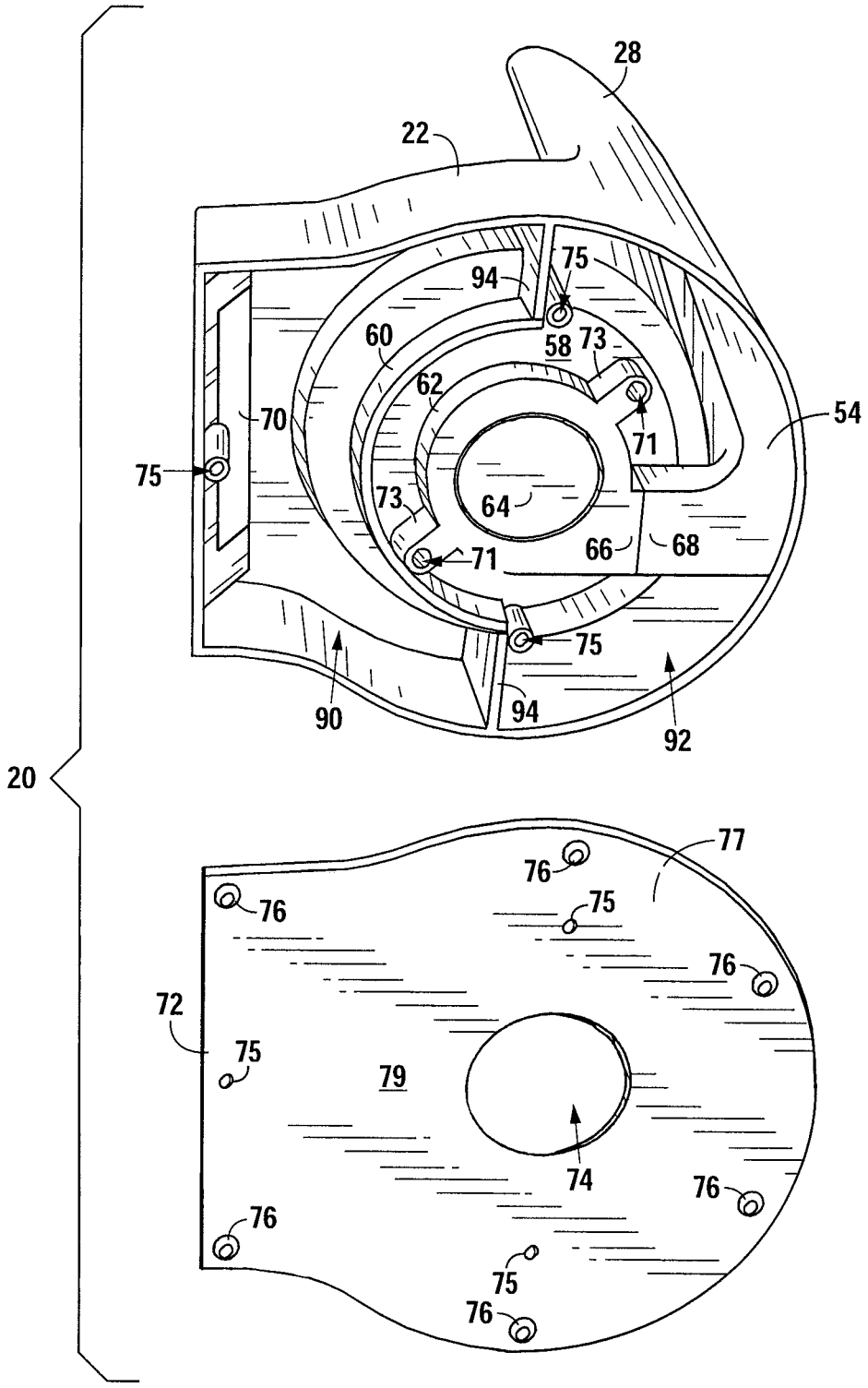
FIG. 6 is a bottom partial assembly view of the preferred embodiment.

Referring to FIG. 6, the blower 64 is positioned within the generally-cylindrical blower housing 62, which is fastened to the blower mount 58 at screw holes 71 positioned in a tabs 73 extending from the blower housing 62. The channeling member 54 partially forms the air channel 52 from the blower housing 62 between the channeling member 54 and the back wall 28 of the back member 24 to the vent holes (not shown).

As shown in FIG. 3 and FIG. 6, the interior space of the base 26 is substantially closed off by a bottom cover 72 having a top surface 77 and a bottom surface 79. The bottom cover 72 is fixed to the main housing 22 with screws (not shown). A port 74 is formed in the bottom cover 72 to allow the blower 64 to receive air from below the bottom cover 72. The bottom cover 72 is elevated over surfaces by a plurality of feet 76 positioned at various points around the bottom cover 72.

The bottom cover 72 may be fastened to the main housing 22 at screw positions 75. When so fastened, the interior of the base 26 of the main housing 22 is divided into a front volume 90 and a back volume 92, which are separated by the semicircular shoulder 60 extending downward from the blower mount 58 and two interior walls 94 extending inward from the outer walls of the main housing 22. The interior walls 94 and shoulder 60 are positioned generally below the candle support surface (not shown) to help support the weight of a candle properly resting on the embodiment 20.

Figure 7:
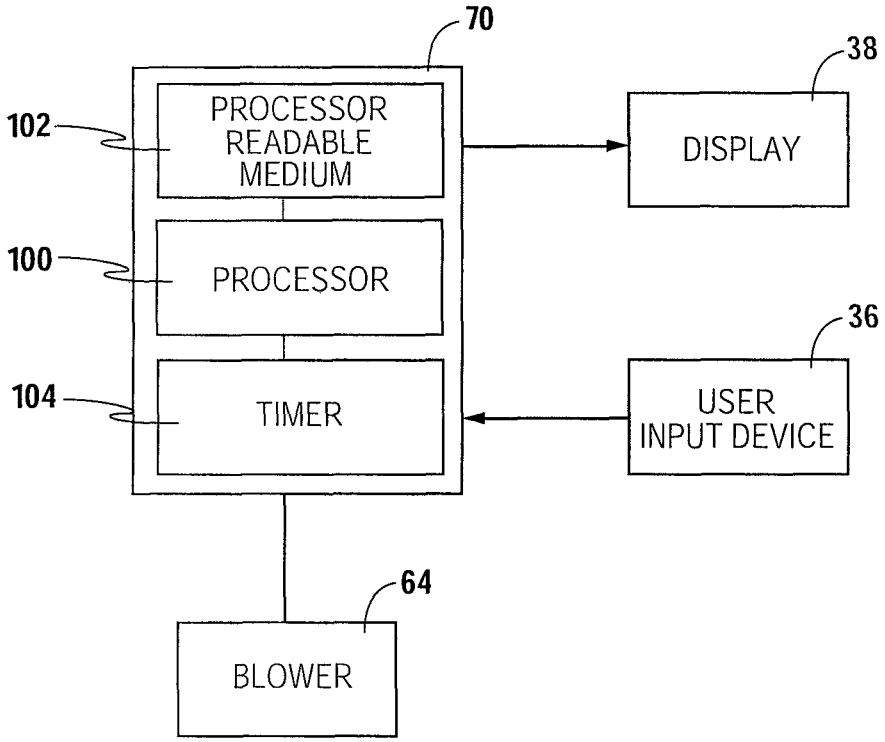
FIG. 7 is a block diagram of the electrical components of the preferred embodiment.

FIG. 7 is a block diagram of the electrical components of the preferred embodiment. The control circuit 70 includes a processor 100 (e.g., a microprocessor or a PIC) electrically connected to both a processor readable medium 102 and a timer circuit 104. The control circuit 70 may receive input from the user input device 36 and return feedback to the user through a display 38. The control circuit 70 is further connected to the blower 64 to cause the activation and deactivation thereof.

Use of the embodiment 20 is described with reference to FIG. 3. Initially, the candle 50 is placed on the support surface 44 in the circular depression 40 and lit. The spiked member 47 penetrates into the wax body of the candle 50 to help inhibit the candle 50 from inadvertently falling. Similarly, the shoulder 45 and back member 24 help keep the candle 50 properly positioned on the support structure 44.

The user may program the time for actuation of the device with the user input device 36 fixed to the front portion 34 of the main housing 22. The control circuit 70 accepts user input received from the user input device 36 indicating when the blower 64 should activate. This may be determined based on a time differential from the time of the user input (e.g., two hours from present) or at an absolute time (e.g., 8:00 p.m.).

At the designated time of activation, the blower 64 is activated by the control circuit 70. When activated, the blower 64 takes ambient air proximal to the port 74 and displaces it to and through the outlet 66 of the blower housing 62. To aid with air flow, the shoulder 60 prevents air contained in the front volume forward of the shoulder 60 from being received by the blower.

The air displaced by the blower is forced into the air channel formed by the channeling member 54 and the interior surface 56 of the back wall 28 until the air flow reaches the vent plate 46. The air flow is thereafter directed through the vent holes 32 toward the candle 50, causing the flame to extinguish.

The curvature of the vent plate 46 causes air from the vent holes 32 to be directed toward an axis extending perpendicularly from the center of the support surface 44. Because of basic fluid dynamics principles, air flow through the vent holes is focused and flows at a faster rate than if air was direct through a large opening, thus being more effective to extinguish the candle when compared to unchanneled air.

The present invention is described in terms of a preferred illustrative embodiment of the invention. Those skilled in the art will recognize that yet other alternative embodiments of such a device can be used in carrying out the present invention. Other aspects, features, and advantages of the present invention may be obtained from a study of this disclosure and the drawings, along with the appended claims.

I claim:

1. An automated candle blower comprising:

a main housing having a base and a back member enclosing a first interior space, said back member comprising a front wall and a back wall, said front wall of said back member having a plurality of vent holes therethrough, wherein at least a first vent hole of the plurality of vent holes is at a first vertical height in said front wall and at least a second vent hole of the plurality of vent holes is at a second vertical height in said front wall;

a candle support surface formed adjacent said back member;

a blower positioned to direct air to said plurality of vent holes, wherein said directed air extinguishes a lit candle; and an air channel within said main housing formed between said blower and said plurality of vent holes.

2. The automated candle blower of claim 1 further comprising:

a control circuit having a processor and a timer, said control circuit being electrically connected to said blower;

a user input device electronically connected to said control circuit.

3. The automatic candle blower of claim 2 wherein said back member further comprises:

an opening through said front wall;

a vent plate positioned within said opening;

wherein said plurality of vent holes are disposed through said vent plate.

4. The automatic candle blower of claim 1 further comprising a blower housing having an inlet and an outlet, said blower being positioned with said main housing, wherein said blower is mounted within said blower housing.

5. The automatic candle blower of claim 1 further comprising a channeling member positioned within said main housing, said channeling member defining at least a portion of said air channel.

6. The automatic candle blower of claim 4 further comprising a bottom cover having a top surface, said bottom cover being fastened to said base to enclose a second interior space defined by the volume between said base and said top surface of said bottom cover.

7. The automatic candle blower of claim 1 wherein said front surface of said back member is curved at least partially around a space above the candle support surface.

8. The automatic candle blower of claim 1 wherein at least some of said vent holes are angled downwardly relative to a horizontal plane.

9. The automatic candle blower of claim 1 wherein each of the vent holes is oriented to direct air radially inward toward an axis perpendicular to and intersecting the candle support surface.

10. The automatic candle blower of claim 2 wherein said control circuit further comprising a processor-readable medium, wherein said processor-readable medium comprises a set of instructions to perform the steps of:

receiving user input from said user input device, said user input being representative of a time;

interpreting said user input to determine an interpreted time to activate said blower;

activating said blower at said interpreted time;

deactivating said blower.

11. The automatic candle blower of claim 7 wherein the front surface of said back member is substantially concave.

12. The automatic candle blower of claim 6 wherein said second interior space comprises a front volume and a back volume, said front and back volumes being separated by a barrier.

13. The automatic candle blower of claim 12 wherein said blower, said blower housing, and at least a portion of said air channel are located within said back volume.

14. The automatic candle blower of claim 1 further comprising a spiked member extending from said support surface.

15. The automatic candle blower of claim 5 further comprising:

upper and lower lips at ends of said vent plate;

wherein each of said lips are positioned between an interior surface of said front wall of said back member and a front wall of said channeling member.

16. A method of extinguishing a candle comprises the steps of:

supporting a candle on a candle support surface, said candle support surface being adjacent to a back member having a plurality of vent holes therethrough, wherein at least a first vent hole of the plurality of vent holes is at a first vertical height in said front wall and at least a second vent hole of the plurality of vent holes is at a second vertical height in said front wall, and a first interior space, said vent holes being orientated to direct air toward a space above the candle support surface;

activating a blower at a first time;

directing air flow from said blower to said plurality of vent holes, wherein the air flow extinguishes a lit candle; and deactivating said blower.

17. The method of claim 16 further comprising the steps of:

accepting first user input with a user input device, said first user input being representative of the value of a first time variable;

providing said first user input to a control circuit electrically connected to said blower, said control circuit comprising a processor and a timer;

deriving said first time from first time variable.

18. The method of claim 17 further comprising the steps of:

accepting second user input with said user input device, said second user input being representative of the value of a second time variable;

providing said second user input to said control circuit;

deriving a second time from said second time variable;

deactivating said blower at said second time.

19. The method of claim 16 wherein said directing step comprises the step of channeling said air flow into an air channel between said blower and said plurality of vent holes, said air channel formed at least partially within a said first interior space.

20. The method of claim 19 wherein said air channel is at least partially defined by the interior surface of a back wall of said back member and a channeling member having a front wall and two vertical sidewalls, and said air channel is partially defined by.

* * * * *